US005788179A

United States Patent [19]

Wicke

[11] Patent Number: 5,788,179

[45] Date of Patent: Aug. 4, 1998

[54] MISSILE STAGE IGNITION DELAY TIMING FOR AXIAL GUIDANCE CORRECTION

[75] Inventor: Dallas C. Wicke, Garden Grove, Calif.

[73] Assignee: McDonnell Douglas Corporation, Huntington Beach, Calif.

[21] Appl. No.: 740,414

[22] Filed: Oct. 29, 1996

[51] Int. Cl.[6] ..... F41G 7/34; F41G 7/36; F41G 7/30

[52] U.S. Cl. ..... 244/3.15; 244/3.14; 244/3.1

[58] Field of Search ..... 244/3.1, 3.11, 244/3.14, 3.15, 3.2; 89/1.11; 342/62; 102/374, 377, 380; 60/225, 256; 364/223.1, 424.012, 424.013, 424.023

[56] References Cited

U.S. PATENT DOCUMENTS

| | | | |
|---|---|---|---|
| 3,128,600 | 4/1964 | Oldham | 60/256 |
| 3,568,954 | 3/1971 | McCorkle, Jr. | 244/3.2 |
| 3,758,052 | 9/1973 | McAlexander et al. | 244/3.14 |
| 3,876,169 | 4/1975 | Fitzgerald et al. | 244/3.14 |
| 4,470,562 | 9/1984 | Hall et al. | 244/3.2 |
| 4,736,583 | 4/1988 | Hudema et al. | 60/256 |
| 4,741,502 | 5/1988 | Rosen | 244/172 |
| 5,071,087 | 12/1991 | Gray | 244/3.15 |

OTHER PUBLICATIONS

Antitactical Ballistic Missile Global Effectiveness Model (AGEM) Intercept Algorithm, by Lawton and Byrum, NSWCDD/TR-92/527, NSWC Dahlgren, VA, Jul. 1994.

Cut-Off Insensitive Guidance with Variable Time of Flight, John E. White, Sandia National Laboratories, Jan. 1993.

*Primary Examiner*—Charles T. Jordan
*Assistant Examiner*—Christopher K. Montgomery
*Attorney, Agent, or Firm*—Harness Dickey & Pierce P.L.C.

[57] ABSTRACT

An ignition delay timing system, and corresponding method, for adjusting the position of an in-flight missile during its boost phase along its flight path according to a pre-launch flight path solution. The ignition delay system of the present invention is applied by navigating missile position between burnout of a given booster stage and ignition of a subsequent booster stage, and modifying ignition time of the subsequent boost stage so that the missile position along its flight path follows a pre-launch solution after all booster stages are burned. Nominal missile coast phases, which occur between burnout of one booster stage and ignition of subsequent booster stage are either increased or decreased for earlier or later booster stage ignitions to maintain the missile position along its flight path in accordance with the pre-launch solution.

10 Claims, 3 Drawing Sheets

MISSILE STAGE IGNITION DELAY TIMING FOR AXIAL GUIDANCE CORRECTION

BACKGROUND OF THE INVENTION

The present invention relates generally to ballistic missile defense systems, and more particularly, to a guidance system for an interceptor missile that is operative during the boost phase of the missile to control missile position on its flight path through selective adjustment of the ignition timing of missile booster stages.

A launched interceptor missile typically includes guidance and control electronics that follows a set sequence of events. First, the missile is launched based on a prelaunch trajectory solution that satisfies a specified intercept point. Next, as the missile is guided through its boost, or ascent, phase, the system corrects for missile errors, navigation errors, atmospheric winds and other sources of error that tend to steer the missile off course. Also, as the missile advances along its flight path after boost phase termination, onboard missile navigation updates are downlinked to a ground based missile guidance segment to enable the ground based segment to communicate updates on predicted target position to the missile. Midcourse and terminal missile flight phase guidance corrections are also made prior to the missile reaching its intercept point.

Conventional missile guidance systems provide target point flight correction through additional correction capability, or impulsive velocity, to the missile payload to correct errors accumulated during the boost phase. In another conventional approach, missile thrust termination between the first, second and third missile flight stages corrects missile flight errors. Other missile guidance control systems control the missile flight path through guidance energy management (GEM) maneuvers which involve an energy wasting maneuver, such as pitching the missile upwardly or downwardly or sending the missile through a corkscrew maneuver.

However, such error correction techniques typically increase payload size due to the additional fuel and/or components required to perform the required function. Additionally, certain of the prior error correction techniques, such as the GEM maneuver, require the missile to have a large angle of attack. Therefore, when error correction is performed, large aerodynamic moments are created which in turn add stress to the control capability of the missile.

SUMMARY OF THE INVENTION

The present invention provides an ignition delay timing system, and corresponding method, for adjusting the position of an in-flight missile during its boost phase along its flight path according to a pre-launch flight path solution. The ignition delay system of the present invention is applied by navigating missile position between burnout of a given boost stage and ignition of a subsequent boost stage, then modifying ignition time of the subsequent boost stage so that the missile position along its flight path follows a pre-launch solution after all booster stages are burned. Nominal missile coast phases, which occur between burnout of one booster stage and ignition of subsequent booster stage are either increased or decreased to permit earlier or later ignitions, as necessary, to maintain the missile position along its flight path in accordance with the pre-launch solution.

DETAILED DESCRIPTION OF THE PREFERRED EMBODIMENT

Figure 1:
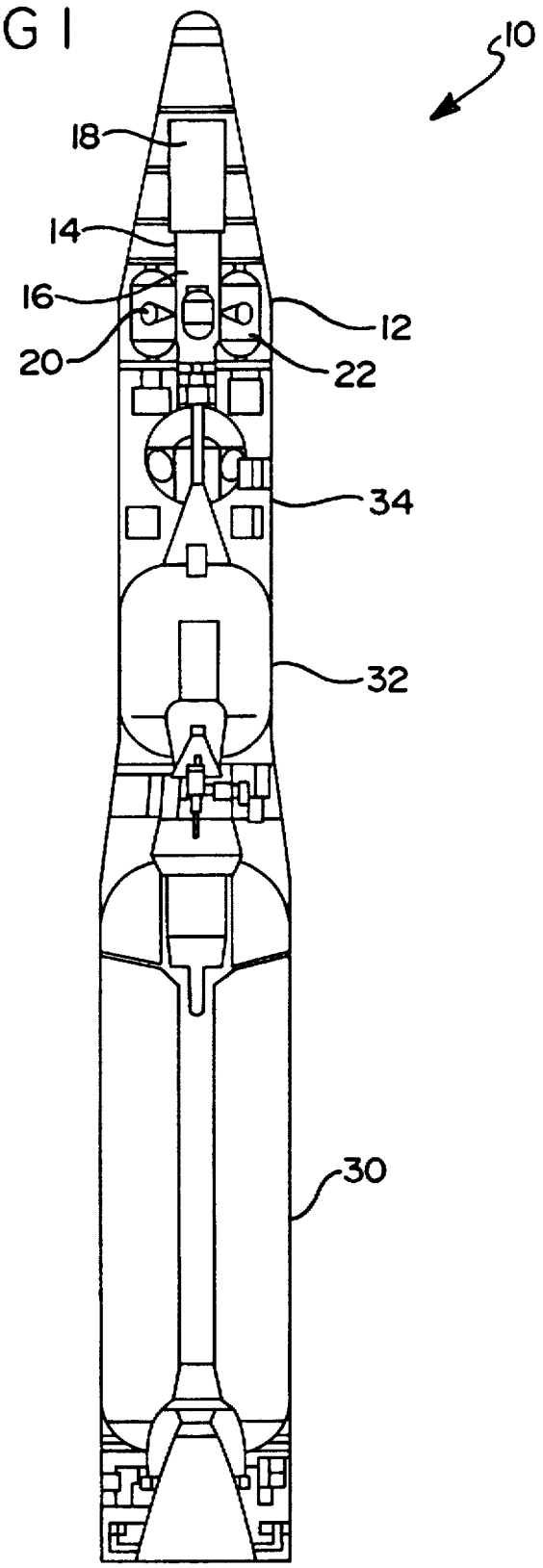
FIG. 1 illustrates a side elevational view, with a portion of its outer shell broken away, of a missile including an integrated boost phase missile guidance system according to the present invention.

Referring now to the drawings, FIG. 1 illustrates a missile 10 in which the preferred embodiment of the present invention may be utilized. The missile shown is a typical strategic defense missile. However, the present invention may also be implemented in any strategic or tactical defense missiles, including surface to air, or conventional space launch vehicles for guidance and control purposes. For purposes of this description, the term "missile" will be used to refer in general to any launched vehicle capable of being guided by the missile ignition delay system of the present invention, as described below.

Further referring to FIG. 1, the missile 10 includes a kill vehicle which constitutes the payload, shown generally at 12. The payload includes guidance control electronics 14 and onboard navigation electronics 16 of the type deployed in conventional strategic and tactical defense missiles. The payload also includes additional components, such as a sensor 18. Also located on the payload is a steering mechanism 20 which may be thrustors or other apparatus for adjusting the attitude or angle of attack of the missile in response to commands from the guidance control electronics 14 as will be described in detail below. The payload also includes a propulsion system 22 including fuel for propelling the kill vehicle to its intended target.

Modular booster stages 30, 32 and 34 are also operatively affixed to the payload 12. Each of the missile booster stages 30, 32 and 34 includes missile fuel and missile propulsion devices such as solid propellant rocket motors for separately propelling the missile along its planned trajectory at flight path angle $\gamma$ achieving velocity represented by the velocity vector V in three stages, as is well known in the art and as will be described in more detail below. Each booster stage includes control devices such as thrust vector control or reaction type attitude control systems and/or aerodynamic control devices which respond to the guidance and control electronics located in the payload section.

Figure 2:
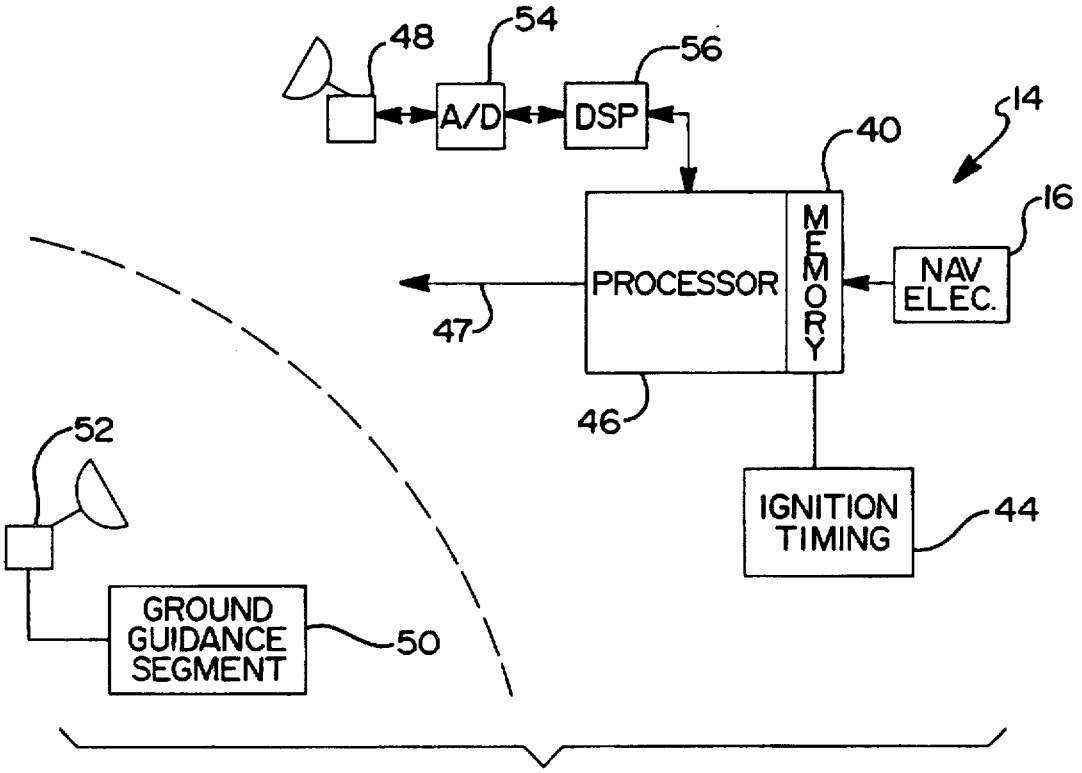
FIG. 2 is a block diagram of the integrated boost phase missile guidance system of the present invention.

Referring to FIG. 2, the diagram of the guidance control electronics 14 is shown. The guidance control electronics includes a memory 40 programmed with the boost phase missile guidance system commands according to the present invention and a processor 46 for executing this logic stored in the memory 40. In particular, the memory 40 and the processor 46 implement the ignition delay system 44 of the present invention discussed below in detail. An antenna 48 of the type RF is operatively connected to the processor 32 for providing a link between the onboard guidance control electronics 14 and a ground based control system 50 and the ground based antenna 52. The antenna receives analog signals from the ground based antenna 52 which are converted to digital signals through the analog to digital converter 54 and processed through the digital signal processor 56 before being input into the processor 46, as is conventional in the art.

Figure 3:
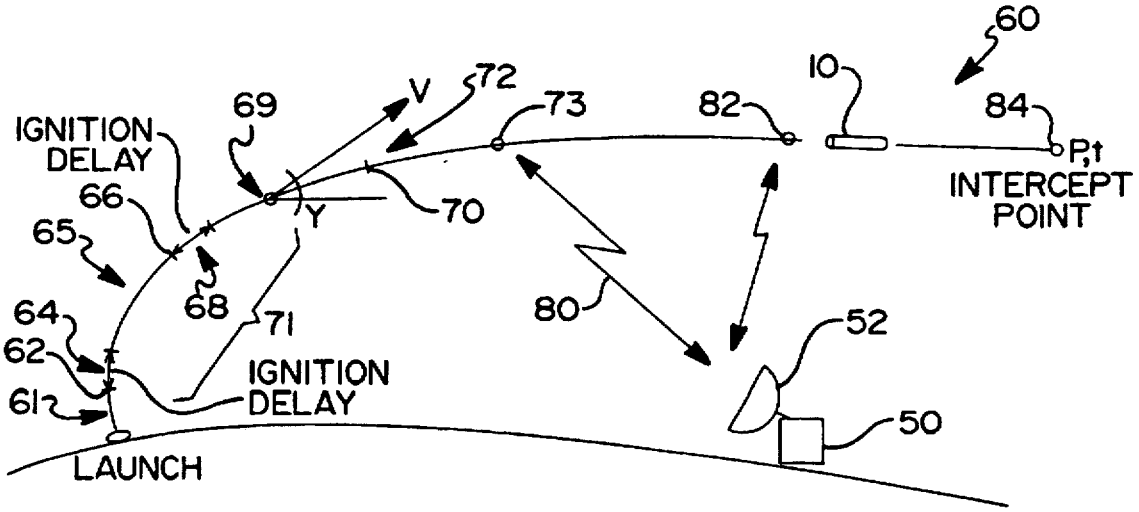
FIG. 3 is a schematic view illustrating the flight path of the missile of FIG. 1.

Referring to FIG. 3, a diagram indicating the various stages of flight of the missile 10 is shown generally at 60 and will now be generally described. Initially, as the missile is launched, the first booster stage 30 is ignited and propels the missile through a burn stage 61 until it reaches a burnout stage 62. Subsequently, the missile enters a coast stage 64 until the second booster stage 32 is ignited. The second booster stage 32 subsequently propels the missile through a burn stage 65 until it reaches a burnout stage 66, at which time the missile enters a second coast stage 68. The missile subsequently remains in the coast stage 68 until the third booster stage 34 is ignited. The third booster stage 34 then propels the missile through a third burn stage 69 until it reaches a burnout stage 70. The combination of the three booster stages will be referred to as the missile boost phase 71. Subsequently, the missile enters a third coast stage 72 until the payload passes through a first node 73, at which time the missile guidance and navigational electronics 14, 16 communicate with a ground based guidance segment 50 through the directional antenna 52 via downlink 80. As will be explained in more detail below, the ground based guidance system 50 subsequently provides an uplink through the directional antenna 52 to the missile at an inflight target update (IFTU) point 82 to provide final target tracking information to the missile to guide the missile to its intercept point 84.

Still referring to FIG. 3, the missile ignition delay system of the present invention provides for correction of missile position along its pre-launch flight path 85 during missile boost phase. The logic for the ignition delay system, which includes burnout detection logic 86, of the present invention is programmed into memory 40 (FIG. 2) via FORTRAN programming language, or any other software programming language well known to those skilled in the art. The ignition delay system of the present invention is capable of operating as a stand alone position error correction system within the missile guidance electronics 14, or may be integrated into an existing missile flight path error correction system through minor programming changes to the missile guidance electronics 14.

The ignition delay system 44 operates in a conventional missile between burnout and coast stages between first and second booster stages and second and third booster stages to adjust the ignition timing of the subsequent booster stage to correct missile position along the missile flight path. Moreover, the system could be programmed to operate during only one or more than two, coast stages, depending upon specific missile configuration. The ignition times for the second and third booster stages are adjusted to compensate for errors accrued in prior booster stages along the vehicle flight path.

Figure 4:
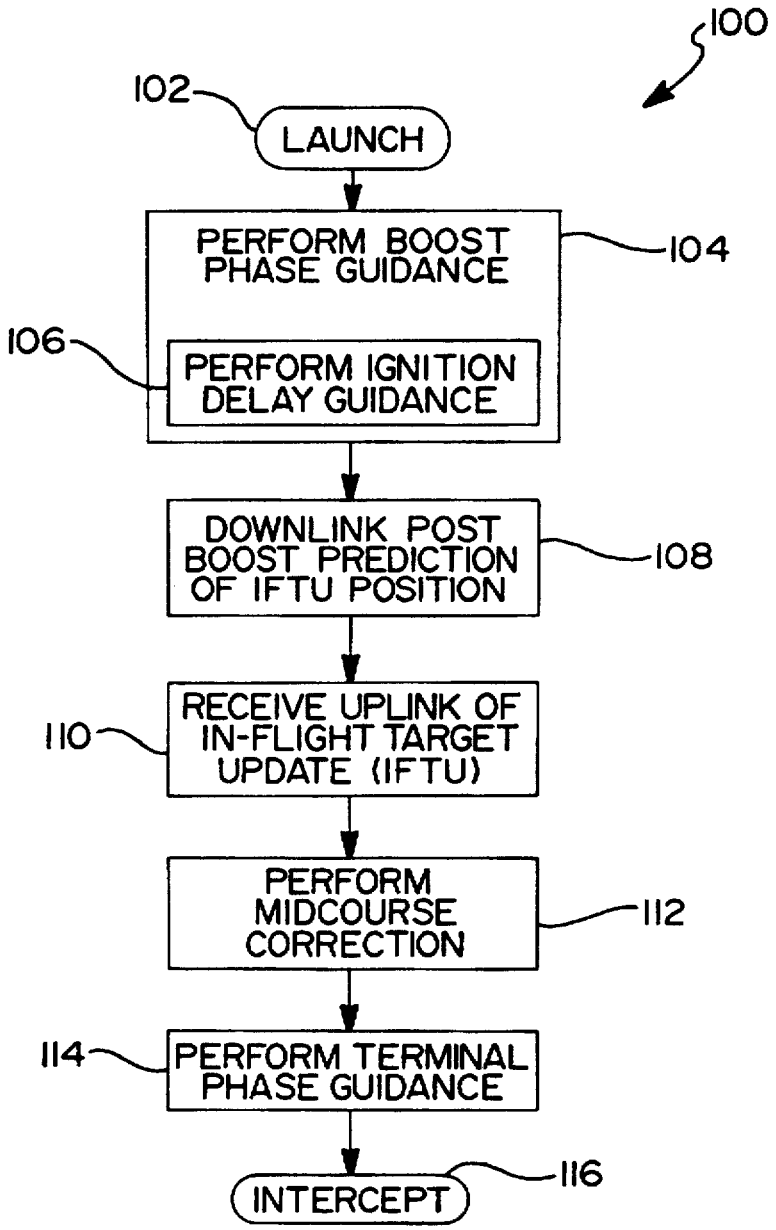
FIG. 4 is a flow diagram illustrating the methodology programmed into the missile guidance system, including the ignition delay system of the present invention.

As part of boost phase guidance, indicated at step 104 in FIG. 4, the burnout detection logic 86 determines the end of the booster stages and the beginnings of the missile coast stages for the first and second booster stages. The burnout detection logic is employed to identify actual burnout time of each booster stage and is important as it is the basis for the logical path to ignition delay guidance sequences. The system 44 requires that nominal coast times be planned between booster stages to allow for either earlier or later ignitions, depending upon the particular missile position along its flight path. If a missile coast stage has been initiated, at step 106 the ignition delay sub-system 44 performs ignition delay guidance via the on-board guidance electronics 14 by adjusting ignition of the particular booster stage in response to missile flight path position data from the on-board navigation electronics 16.

The ignition delay guidance sub-system 44 requires that on-board navigation electronics data is obtained during a vehicle coast stage to insure that the navigation data fully reflects the actual performance of the spent stage and is not corrupted by a partial burning of the next stage. The position error along the path relative to nominal, and a subsequent ignition time adjustment, is computed for an upcoming booster stage to eliminate position error accumulated up to that point in missile flight.

The ignition delay system logic which is programmed into the memory 40 includes the following equations used to determine timing of the ignition delay for the second and third stages:

Second Stage Ignition:

$$t_{IG2}=t_{IG2}\text{nom}+[(|V|-|V\text{nom}|)(t_{comm}-t)+(P-P\text{nom})\cdot\text{unit}(V\text{nom})]/(V_{G2}+V_{G3})$$

Third Stage Ignition:

$$t_{IG3}=t_{IG3}\text{nom}+[(|V|-|V\text{nom})\ (t_{comm}-t)+(P-P\text{nom})\cdot\text{unit}(V\text{nom})]/\ V_{G3}$$

10 where $t_{IGi}$=guidance ignition time for stage i $t_{IGi}$nom=nominal ignition time for stage i t=time at which navigation data are taken for ignition guidance (after prior stage burnout) (must also be a time which is in coast period of nominal trajectory)

$t_{comm}$=time at which communication down link is scheduled (for purposes of communicating predicted interceptor position at IFTU time and Health and Status of interceptor after boost V=actual velocity at time t Vnom=nominal velocity at time t P=actual position vector at time t Pnom=nominal position vector at time t $v_{Gi}$=nominal velocity magnitude to be gained by stage i (in full burn along nominal trajectory)

Ignition adjustments can be positive or negative. Therefore, the nominal trajectory must have additional built-in coast time. The delta coast times for this purpose are as follows:

Δtcoast2=built-in coast before second state ignition

=function of nominal flight path angle at first stage burnout

Δtcoast3=built-in coast before third state ignition

It should be appreciated from the above that overall missile coast time for the missile is equal to: (1) nominal coast time due to controllability constraints programmed into the missile guidance electronics; (2) nominal coast time built into the guidance control electronics; and (3) the delay due to the ignition control guidance system of the present invention. Because the overall coast time contributors have statistical variation, sufficient nominal coast time must be programmed into the prelaunch solution to have an acceptably high confidence of allowing the desired ignition time caused by the ignition delay system of the present invention to be realized.

In addition, the ignition delay guidance system of the present invention may be realized as a separate guidance control system as in conjunction with a system, such as the control system disclosed in pending U.S. patent application Ser. No. 08/738,622 filed concurrently herewith, for "Multiple Node Lambert Guidance System" to cause the missile to reach a prelaunch solution flight path accurately in both position and time. Also, it should be appreciated that, when actual burnout of the third boost stage occurs, residual velocity error results. Such error may be corrected by a propulsive burn, which may be provided by the payload propulsion system 22 with a modest error budget.

Referring to FIG. 4, flow diagram illustrating the overall methodology of missile guidance error correction system is shown generally at 100, including the ignition delay system of the present invention. At step 102, the missile is launched. Subsequently at step 104, missile guidance control electronics performs missile guidance functions during the missile boost phase 71. Included in this boost phase guidance is the ignition delay system of the present invention, which is operative between booster stages of the boost phase, as indicated at step 106. The ignition delay system adjusts the length of the coast stages 64, 68 in response to the missile flight path position data collected by navigation electronics 16. After the missile boost phase, and upon the missile reaching the predetermined way point 73, at step 108 missile navigation data is communicated to the ground base guidance system 52 through the directional antenna 50 for calculation of post boost prediction of the IFTU position. As the missile reaches the IFTU point, updated missile intercept point information is uplinked to the missile at step 110. Subsequently, missile guidance control electronics perform mi d course corrections at step 112, and terminal phase guidance of the missile at step 114 before the missile reaches its intercept point as indicated at step 116.

As can be appreciated from reading the foregoing description, the ignition delay guidance system of the present invention is effective in correcting deviation of a missile from its pre-launch solution flight path through adjustment of the ignition times of successive missile boost stages. The system of the present invention does not require additional components or cost associated with thrust termination devices or propellant segmentation as in conventional art missile position correction systems. The system of the present invention thereby increases the accuracy of the missile in reaching particular points on the flight path, such as communication link points and the missile intercept point, according to missile pre-launch solution.

While the above detailed description describes the preferred embodiment of the present invention, the invention is susceptible to modification, variation and alteration without deviating from the scope and fair meaning of the subjoined claims.

What is claimed is:

1. A missile system, comprising:

a missile;

a plurality of missile booster stages for propelling said missile during a missile boost phase, said plurality of missile booster stages having an associated booster stage ignition system for successive ignition of each one of said plurality of missile booster stages;

a memory programmed with a plurality of missile guidance commands including missile ignition timing logic for adjusting coast times of said missile between said missile booster stages;

a processor operative to execute said missile ignition timing logic based on missile navigation information input to said processor through a processor input and to generate a plurality of missile ignition timing commands;

control means for communicating said executed missile ignition timing commands from said processor to said booster stage ignition system for adjustment of said missile coast times to correct missile flight path position relative to a pre-launch solution;

said Plurality of missile ignition timing commands comprising ignition timing commands for controlling ignition of said missile booster stages between first and second missile booster stages and between second and third missile booster stages; and wherein said missile ignition timing command between said first and second booster stages is derived from the following equation:

$$t_{IG2}=t_{IG2}\text{nom}+[(|V|-|V\text{nom}|)(t_{comm}-t)+(P-P_{nom})\cdot\text{unit}(V\text{nom})]/(V_{G2}+V_{G3})$$

where $t_{IG2}$=guidance ignition time for stage 2;

$t_{IG2}$nom=nominal ignition time for stage 2;

t=time at which navigation data are taken for ignition guidance (after prior stage burnout);

$t_{comm}$=time at which communication down link is scheduled;

V=actual velocity at time t:

Vnom=nominal velocity at time t;

P=actual position vector at time t;

Pnom=nominal position vector at time t; and $V_{Gi}$=nominal velocity magnitude to be gained by stage i.

2. The system of claim 1, wherein said missile guidance ignition control command between said second and third boost stages is derived from the following equation:

$$t_{IG3}=t_{IG3}\text{nom}+[(|V|-|V\text{nom}|)(t_{comm}-t)+(P-P_{nom})\cdot\text{unit}(V\text{nom})]/V_{G3}$$

where $t_{IG3}$=guidance ignition time for stage 3

$t_{IG3}$nom=nominal ignition time for stage 3 t=time at which navigation data are taken for ignition guidance $t_{comm}$=time at which communication down link is scheduled V=actual velocity at time t Vnom=nominal velocity at time t P=actual position vector at time t Pnom=nominal position vector at time t $V_{Gi}$=nominal velocity magnitude to be gained by stage i.

3. The system of claim 1, wherein said missile coast time is programmed into said memory and has a predetermined dedicated length allowing for adjustment by said missile ignition timing commands.

4. A method of guiding a missile to an intended target, comprising the steps of:

providing onboard missile control electronics including a memory and a processor, and missile navigation electronics;

storing a plurality of missile guidance commands including booster stage ignition times in said memory in accordance with a pre-launch flight path;

measuring missile flight path position data through said missile navigation electronics;

calculating missile position error from data collected in said step of measuring missile flight path position; and adjusting ignition times of successive missile booster stages to compensate for missile position errors accrued in a prior booster stage and a prior coast phase as determined in said step of calculating missile position error.

5. The method of claim 4, wherein said step of adjusting ignition times comprises calculating ignition time for a booster stage from the following equation:

$$t_{igi}=t_{igi}\text{nom}+[(P-P_{nom})\cdot\text{unit}\ (V_{nom})+(|V|-|V_{nom}|)(t_{guid}-t)]/Vg$$

where $t_{igi}$=guidance ignition time for stage i $t_{igi}$nom=nominal ignition time for stage i t=time at which navigation data are taken (or synchronized to) for ignition guidance t guid =time for which missile position is prescribed (guidance time)

P=actual position at time t

Pnom=nominal position at time t

V=actual velocity at time t

Vnom=nominal velocity at time t

Vg=nominal velocity to be gained by stage i and subsequent stages.

6. The method of claim 5 when said step of adjusting ignition times for said stage comprises calculating ignition time for a second stage through the following equation:

$$t_{IG2}=t_{IG2}\text{nom}+[(|V|-|V\text{nom}|)\ (t_{comm}-t)+(P-P_{nom})\cdot\text{unit}(V\text{nom})]/(V_{G2}+V_{G3})$$

where $t_{IG2}$=guidance ignition time for stage 2

$t_{IG2}$nom=nominal ignition time for stage 2 t=time at which navigation data are taken for ignition guidance (after prior stage burnout)

$t_{comm}$=time at which communication down link is scheduled

V=actual velocity at time t

Vnom=nominal velocity at time t

P=actual position vector at time t

Pnom=nominal position vector at time t $V_{Gi}$=nominal velocity magnitude to be gained by stage i.

7. The method of claim 5, when said step of adjusting ignition time for said stage comprises calculating ignition time for a third stage through the following equation:

$$t_{IG3}=t_{IG3}\text{nom}+[(|V|-|V\text{nom}|)\ (t_{comm}-t)+(P-P\text{nom})\cdot\text{unit}(V\text{nom})]/V_{G3}$$

where $t_{IG3}$=guidance ignition time for stage 3

$t_{IG3}$nom=nominal ignition time for stage 3 t=time at which navigation data are taken for ignition guidance $t_{comm}$=time at which communication down link is scheduled V=actual velocity at time t Vnom=nominal velocity at time t P=actual position vector at time t Pnom=nominal position vector at time t $V_{Gi}$=nominal velocity magnitude to be gained by stage i.

8. A missile system, comprising:

a missile;

a plurality of missile booster stages for propelling said missile during a missile boost phase, said plurality of missile booster stages having an associated booster stage ignition system for successive ignition of each one of said plurality of missile booster stages;

a memory programmed with a plurality of missile guidance commands including missile ignition timing logic for adjusting coast times of said missile, between said missile booster stages, so as to hasten or delay ignition of a second one of said booster stages based upon accumulated missile flight path error occurring during a previous missile coast phase and a previous boost phase, to thus cause a flight path of said missile to conform to a pre-launch flight path;

a processor operative to execute said missile ignition timing logic based on missile navigation information input to said processor through a processor input and to generate missile ignition timing commands; and control means for communicating said executed missile ignition timing commands from said processor to said booster stage ignition system for adjustment of said missile coast times to correct said missile flight path error relative to said pre-launch flight path.

9. The apparatus of claim 8, further comprising a ground based guidance system in communication with said processor for transmitting target update information to said missile at least at one point in the trajectory of said missile.

10. A method of guiding a missile to an intended target, comprising the steps of:

providing onboard missile control electronics including a memory and a processor, and missile navigation electronics;

storing a plurality of missile guidance commands including booster stage ignition times in said memory in accordance with a pre-launch flight path;

measuring missile flight path position data through said missile navigation electronics;

calculating missile position error from data collected in said step of measuring missile flight path position;

adjusting ignition times of successive missile booster stages to compensate for missile position errors accrued in a prior booster stage and a prior coast phase as determined in said step of calculating missile position error at a predetermined way point in the trajectory of said missile, transmitting a signal from said missile navigation electronics to a ground based guidance system;

using said ground based guidance system to generate target update information; and using said ground based guidance system to transmit said target update information to said missile at an inflight target update (IFTU) point to assist in guiding said missile to said intended target.

* * * * *

UNITED STATES PATENT AND TRADEMARK OFFICE

CERTIFICATE OF CORRECTION

PATENT NO. : 5,788,179

DATED : August 4, 1998

INVENTOR(S) : Dallas C. Wicke

It is certified that error appears in the above-identified patent and that said Letters Patent is hereby corrected as shown below:

Column 6, Claim 1, line 16, last line, insert -- - -- (i.e., insert a substraction symbol) after $t_{comm}$. This equation should read ($t_{comm}$ - t).

Column 6, Claim 2, in the equation delete "($P-P_{nom}$)" and insert -- (P-Pnom) --.

Signed and Sealed this

Twentieth Day of April, 1999

*Attest:*

Q. TODD DICKINSON

*Attesting Officer*

*Acting Commissioner of Patents and Trademarks*

UNITED STATES PATENT AND TRADEMARK OFFICE

CERTIFICATE OF CORRECTION

PATENT NO. : 5,788,179

DATED : August 4, 1998

INVENTOR(S) : Dallas C. Wicke

It is certified that error appears in the above-identified patent and that said Letters Patent is hereby corrected as shown below:

Column 1, line 3, insert the following statement after the title:

"This invention was made with Government support under contract DASG60-90-C-0166 awarded by the U.S. Army. The Government has certain rights in this invention"

Signed and Sealed this

Twenty-fifth Day of April, 2000

*Attest:*

Q. TODD DICKINSON

*Attesting Officer*

*Director of Patents and Trademarks*